US008118615B2

(12) United States Patent
Peng et al.

(10) Patent No.: US 8,118,615 B2
(45) Date of Patent: Feb. 21, 2012

(54) CONNECTOR ASSEMBLY HAVING GROUNDING MEANS

(75) Inventors: Fei-Yan Peng, Shenzhen (CN); Xian-Kui Shi, Shenzhen (CN); Chung-Yen Yang, Tu-Cheng (TW)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/968,300

(22) Filed: Dec. 15, 2010

(65) Prior Publication Data

US 2011/0143590 A1 Jun. 16, 2011

(30) Foreign Application Priority Data

Dec. 15, 2009 (CN) ..... 2009 2 0317437

(51) Int. Cl.
*H01R 13/648* (2006.01)

(52) U.S. Cl. ..... 439/607.27

(58) Field of Classification Search ..... 439/607.23–607.27, 92, 95
See application file for complete search history.

(56) References Cited

U.S. PATENT DOCUMENTS

| | | | | |
|---|---|---|---|---|
| 5,797,770 | A * | 8/1998 | Davis et al. | 439/607.27 |
| 6,206,725 | B1 * | 3/2001 | Wu | 439/541.5 |
| 6,264,504 | B1 * | 7/2001 | Wu | 439/607.27 |
| 6,482,037 | B1 * | 11/2002 | Zhu et al. | 439/607.27 |
| 7,044,790 | B2 * | 5/2006 | Zhu et al. | 439/607.27 |
| 7,811,110 | B2 * | 10/2010 | He et al. | 439/218 |
| 7,824,219 | B2 * | 11/2010 | Wang | 439/607.27 |
| 7,828,598 | B2 * | 11/2010 | Wang | 439/607.27 |
| 7,837,506 | B1 * | 11/2010 | Chiang et al. | 439/607.27 |

FOREIGN PATENT DOCUMENTS

CN 201204355 3/2009

* cited by examiner

*Primary Examiner* — Gary F. Paumen
(74) *Attorney, Agent, or Firm* — Wei Te Chung; Andrew C. Cheng; Ming Chieh Chang

(57) ABSTRACT

A connector assembly (100) includes an insulative cover (1) defining a plurality of grooves arranged in a row along a transversal direction; a plurality of connectors (21) accommodated in the grooves, respectively, each of the connectors having a terminal module and a metallic shell enclosing the terminal module; a metallic cage (5) enclosing the insulative cover; and a plurality of conductive members (3), each of the conductive member (3) including a horizontal portion (31) and a vertical portion (32), the horizontal portion having a first tab (311) abutting against the metallic cage, and the vertical portion having a second tab (321) pressing against the metallic shell of a corresponding connector.

20 Claims, 6 Drawing Sheets

CONNECTOR ASSEMBLY HAVING GROUNDING MEANS

BACKGROUND OF THE INVENTION

1. Field of the Invention

The present invention relates to a connector assembly, more particularly to a connector assembly with improved grounding means.

2. Description of Related Art

Nowadays, an electronic device becomes lower profile and multifunctional. So accessories are attached to the electronic device, such as connector assembly should be transmitting fast, smaller contour, simplified and friendly usage. USB and Audio jack are commonly input/output interfaces for a computer or other consumer devices, and those interfaces are commonly mounted to an external cage of a computer or other electronic devices and to link with other peripheral devices. CN Pat. No. 201204355 issued on Mar. 4, 2009 to Sang discloses a connector assembly adapted for mounting to an external cage of a computer. The connector assembly includes an insulative cover, two USB connectors and two Audio connectors enclosed in the insulative cover, and a metallic shell shielding the insulative cover. However, there is no reliable grounding path between the connectors and the metallic shell, which may influence an effect of the connector assembly.

Hence, a connector assembly with improved grounding means is desired.

BRIEF SUMMARY OF THE INVENTION

Accordingly, an object of the present invention is to provide a connector assembly which has reliable grounding means.

In order to achieve the above-mentioned object, a connector assembly in accordance with present invention comprises an insulative cover defining a plurality of grooves arranged in a row along a transversal direction; a plurality of connectors accommodated in the grooves, respectively, each of the connectors having a terminal module and a metallic shell enclosing the terminal module; a metallic cage enclosing the insulative cover; and a plurality of conductive members, each of the conductive member including a horizontal portion and a vertical portion, the horizontal portion having a first tab abutting against the metallic cage, and the vertical portion having a second tab pressing against the metallic shell of a corresponding connector.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENTS

Figure 1:
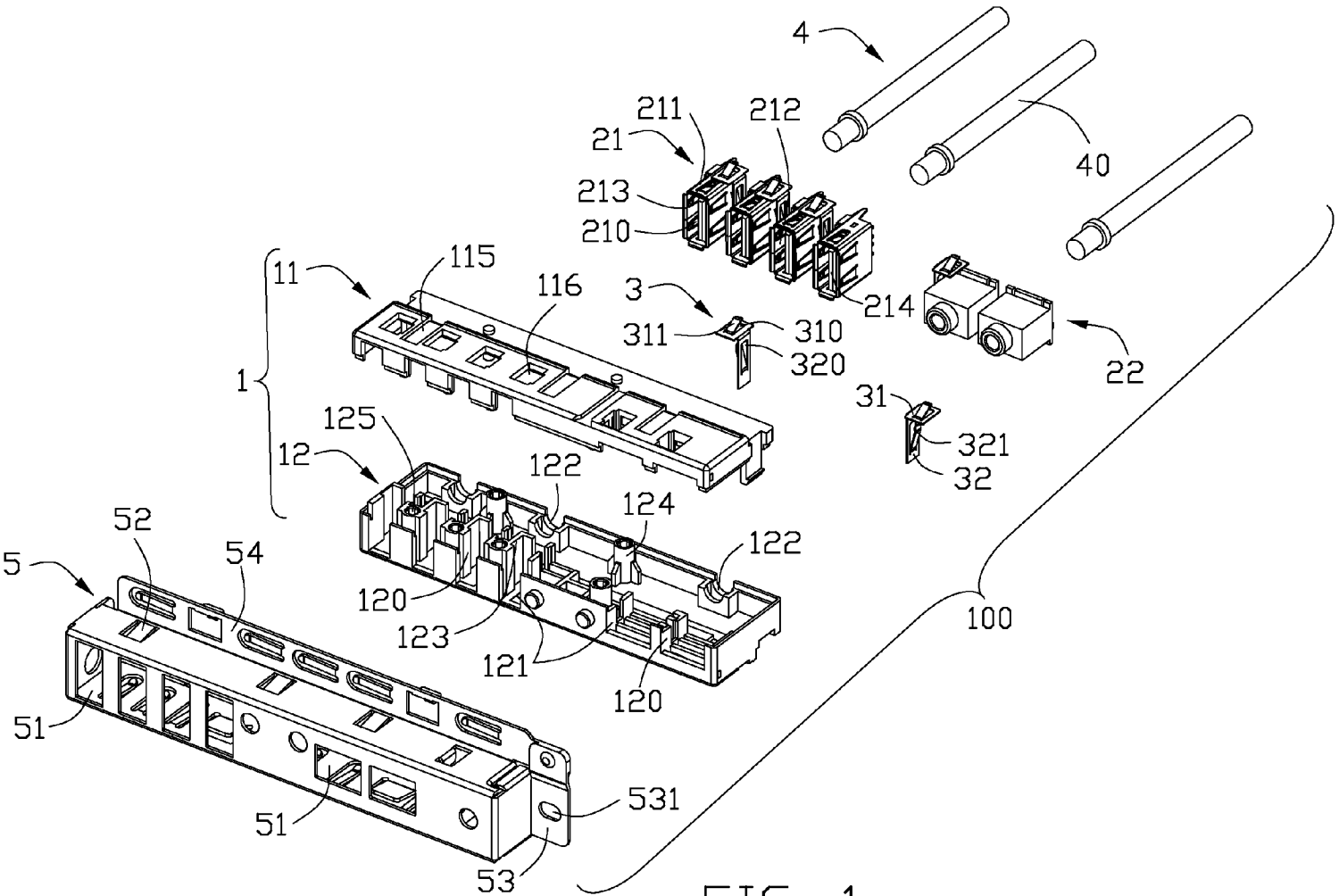
FIG. 1 is an exploded, perspective view of a connector assembly.

In the following description, numerous specific details are set forth to provide a thorough understanding of the present invention. However, it will be obvious to those skilled in the art that the present invention may be practiced without such specific details.

Reference will be made to the drawing figures to describe the present invention in detail, wherein depicted elements are not necessarily shown to scale and wherein like or similar elements are designated by same or similar reference numeral through the several views and same or similar terminology.

Figure 2:
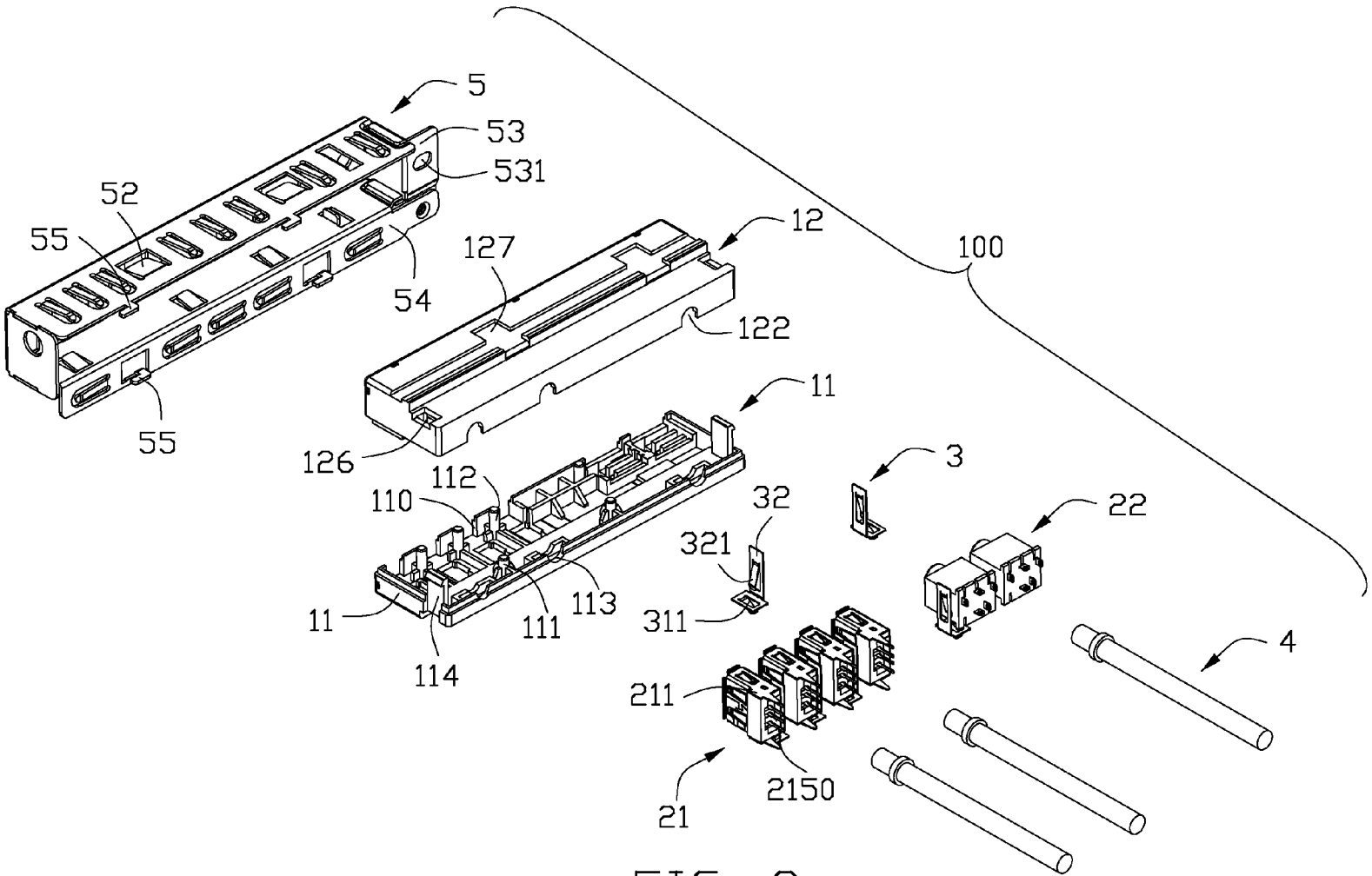
FIG. 2 is similar to FIG. 1, but viewed from other aspect.
Figure 3:
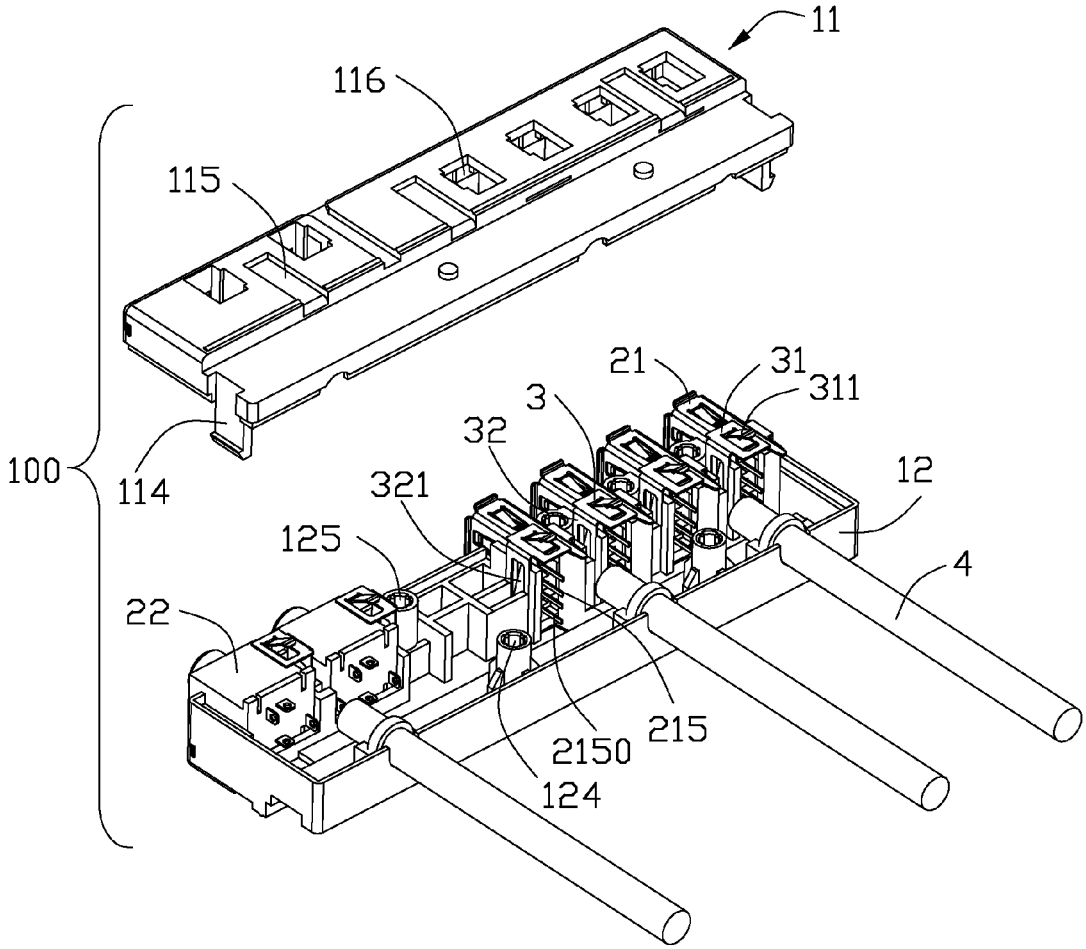
FIG. 3 is a partially assembled, perspective view of the connector assembly.
Figure 4:
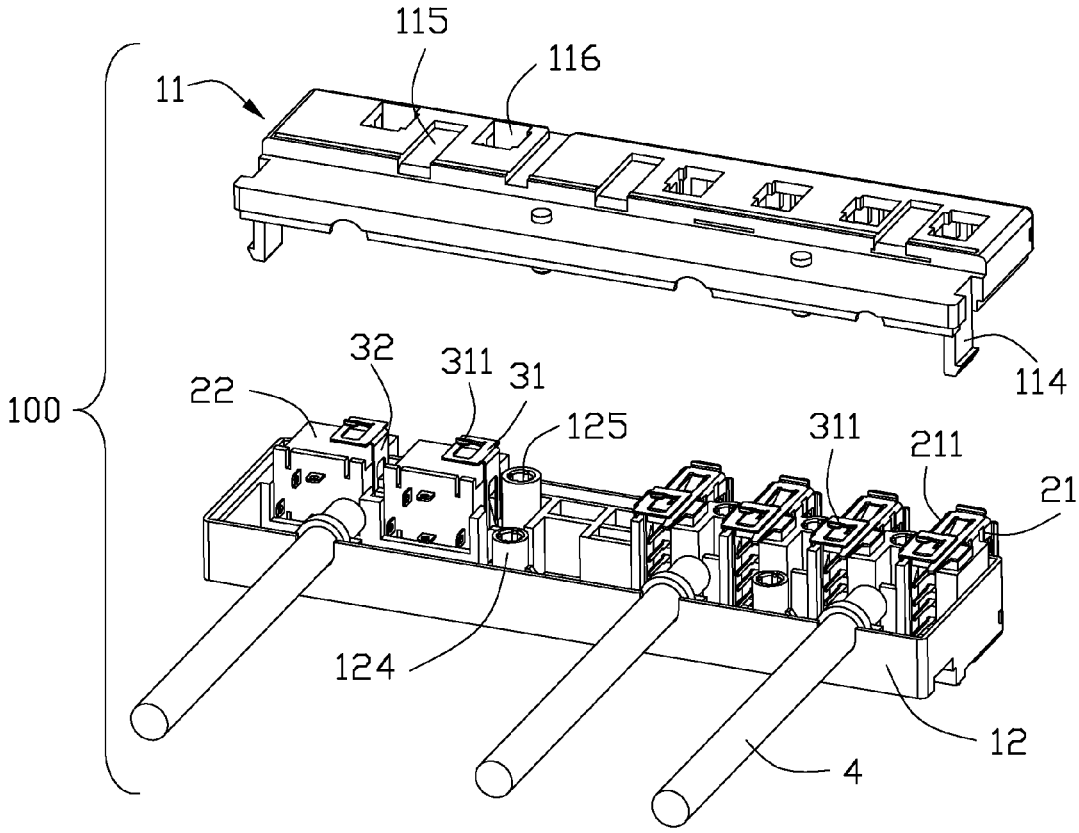
FIG. 4 is similar to FIG. 3, but viewed from other direction.
Figure 5:
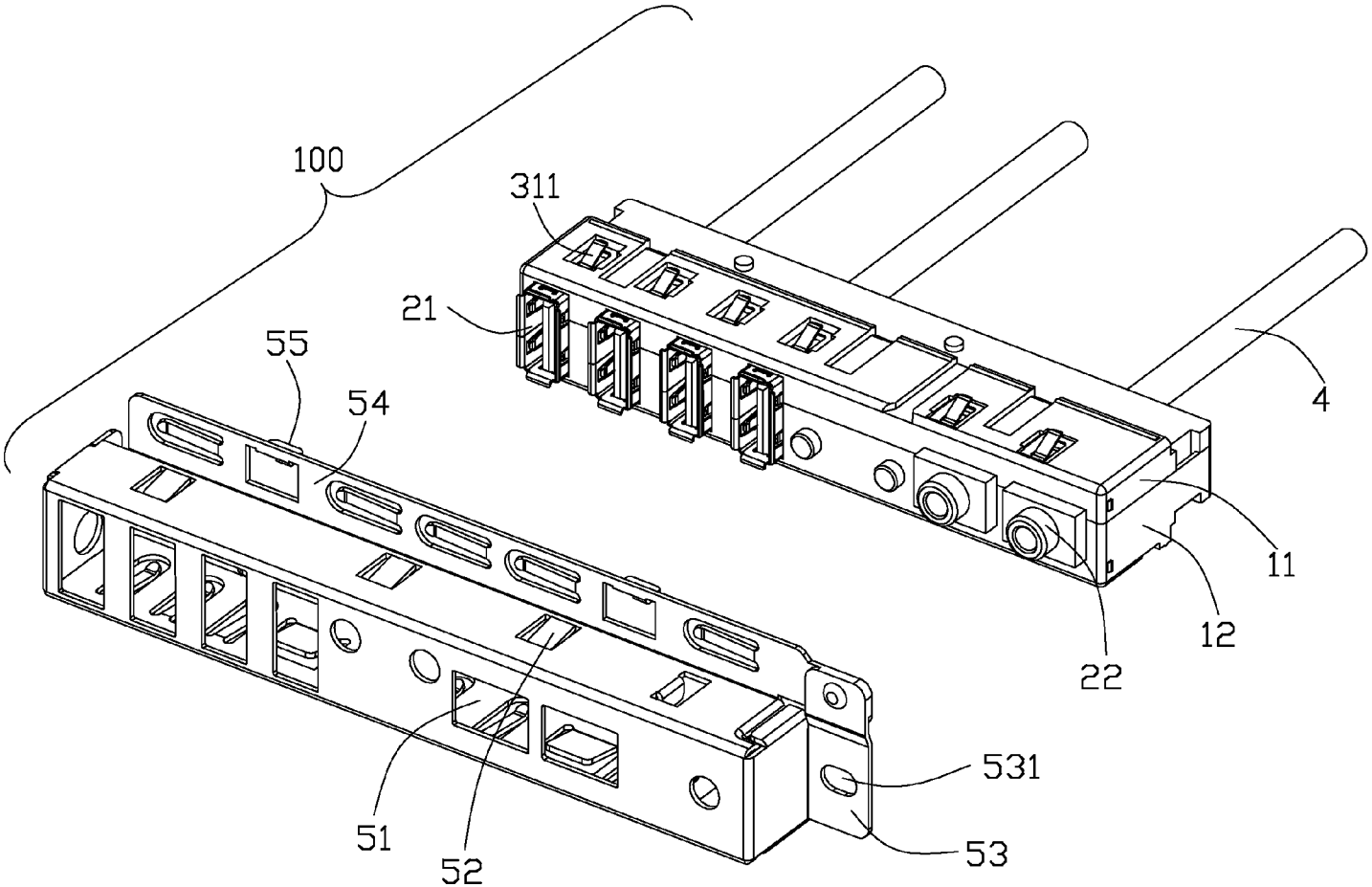
FIG. 5 is other partially assembled, perspective view of the connector assembly.
Figure 6:
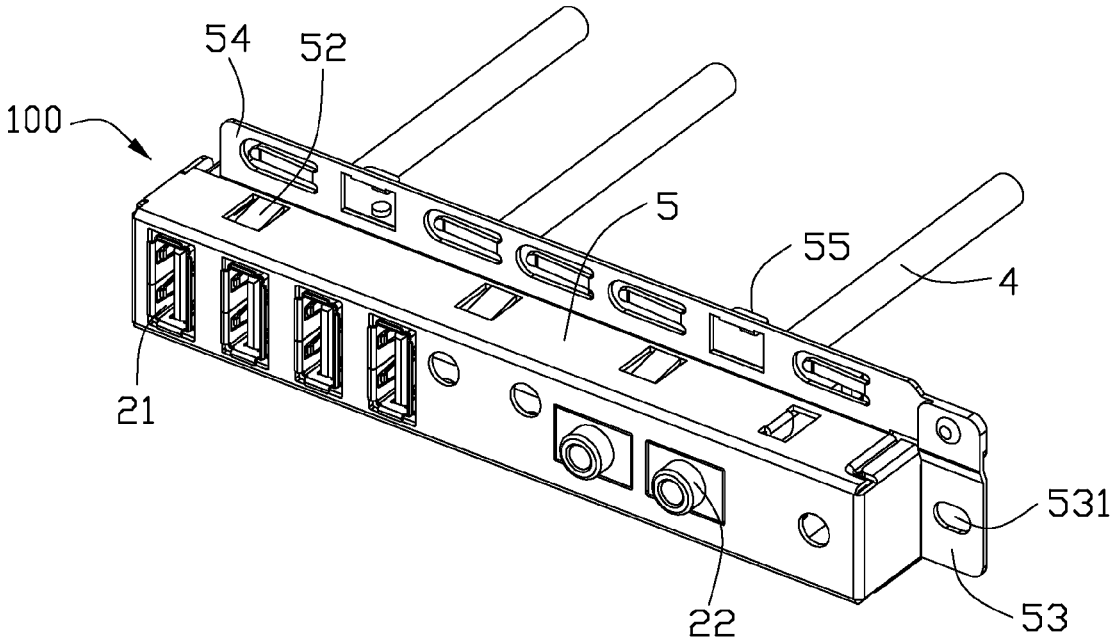
FIG. 6 is an assembled, perspective view of the connector assembly.

Referring to FIGS. 1-6, a connector assembly 100 in accordance with the present invention comprises an insulative cover 1, a number of connectors 2 received in the insulative cover 1, a number of conductive members 3 retained in the insulative cover 1, a number of cables 4 electrically connected to the connectors 2 and a metallic cage 5 shielding the insulative cover 1. Detail description of these elements and their relationship and other elements formed thereon will be detailed below.

The insulative cover 1 includes a top cover 11 and a bottom cover 12.

The bottom cover 12 has six grooves 120 located in a front segment thereof and three semi-circular cable outlets 122 defined in a back wall of the bottom cover 12. The grooves 120 are arranged in a row along a transversal direction. Each groove 120 has a first opening 121 located in the front of the corresponding groove 120. Every two adjacent grooves 120 are separated by a spacer 123. A number of first positioning holes 124 are located in the back segment of the bottom cover 12 and disposed in front of the cable outlets 122, and there are several second positioning holes 125 are located in the front segment of the bottom cover 12 and three of the second positioning holes 125 are defined in the spacers 123, respectively. There are two holes 126 located in lateral sides of a bottom wall of the bottom cover 12. A number of positioning cavities 127 are located in a lower side of the bottom cover 12.

There are six second openings 110 located in a front wall of the top cover 11. A number of first positioning posts 112 are located on a front segment of an upper wall of the top cover 11 and inserted into the first positioning holes 124 respectively. There are several second positioning posts 111 are located on a back segment of an upper wall of the top cover 11 and inserted into the second positioning holes 125 respectively. Three semi-circular cable outlets 113 are defined in a back wall of the top cover 11 and cooperate with the cable outlets 122 to form corresponding circular cable outlets to allow the cables 4 passing through. Two latching arms 114 are formed at lateral sides of the upper wall of the top cover 11 and locked into the holes 126 so as to keep the top cover 11 and the bottom cover 12 together. A number of positioning cavities 115 are located in an upper wall of the top cover 12. A number of windows 116 are defined in the upper wall of the top cover 12.

The connectors 2 are accommodated in the grooves 120, respectively. The connectors 2 include several first connectors 21 and second connectors 22. The first connectors 22 include four USB connectors which have similar structure as commonly used type, i.e. USB 2.0. The second connectors 21 have two Audio jacks which have similar structure as commonly used type. Both the first connectors 21 and the second connectors 22 are electrically coupled to the cables 4.

Each first connector 21 includes a terminal module 210 and a metallic shell 211 enclosing the terminal module 210. The terminal module 210 and the metallic shell 211 together define a mating port 212 exposed outside of the insulative cover 1. The metallic shell 211 has an expanded front end 213. The terminal module 210 has a dielectric body 214 and a plurality of terminals 215 retained with the dielectric body 214. Each terminal 215 has a tail portion 2150 backwardly projecting outside of the dielectric body 214 to be connected with the cable 4. Detailed description of the second connector 22 is omitted hereby.

The conductive member 3 is made of metal sheet. The conductive member 3 is an inverted L-shaped viewed from a back side. The conductive member 3 has a horizontal portion 31 and a vertical portion 32 joining with a lateral edge of the horizontal portion 31. There is a first tab 311 formed on the horizontal portion 31 and obliquely and upwardly extending therefrom. There is a second tab 321 formed on the vertical portion 32 and obliquely and upwardly extending therefrom. The first tab 311 is disposed above and supported by the horizontal portion 31. The second tab 321 is disposed under the horizontal portion 32. The first tab 311 and the second tab 321 are respectively punched from the horizontal portion 31 and the vertical portion 32, therefore there two holes 310, 320 left when they are deflected from original positions.

The metallic cage 5 has a front side with a plurality of slots 51 to allow the first connectors 21 and the second connectors 22 extending outward therethrough. There are a number of locking tabs 52 formed on a top side and a bottom side of the metallic cage 5. The locking tabs 52 extend into interior of the metallic cage 5 and engage with the positioning cavities 115, 127 of the insulative cover 1. There is a mounting section 53 laterally extending from a left side of the metallic cage 5. The mounting section 53 further has a fixing hole 531. A flange 54 extends upwardly from a rear end of the top side of the metallic cage 5. A plurality of hooks 55 are formed on the flange 54 and a back end of the bottom side of the metallic cage 5.

When assembling, the first connectors 21 and the second connectors 22 are respectively put into the grooves 120 of the bottom cover 12 and arranged in a row along the transversal direction. Each conductive member 3 is arranged alongside a corresponding first connector 21 or second connector 22, with the vertical portion 32 sandwiched between the metallic shell 211 of the first connector 21 and the corresponding spacer 123 and the second tab 321 pressing against the metallic shell 211, and the horizontal portion 31 supported by the metallic shell 211. The top cover 11 is assembled to the bottom cover 12 to hold the connectors 21, 22 therebetween. The first tabs 311 of the conductive members 3 protrude outward via the windows 116 of the top cover 11. The top cover 11 and the bottom cover 12 is mounted into the metallic cage 5, with the first tabs 311 abutting against the top side of the metallic cage 5, therefore, a grounding line is formed between the first connector 21 or second conductor 22 and the metallic cage 5 via the conductive members 3.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed. For example, the tongue portion is extended in its length or is arranged on a reverse side thereof opposite to the supporting side with other contacts but still holding the contacts with an arrangement indicated by the broad general meaning of the terms in which the appended claims are expressed.

What is claimed is:

1. A connector assembly, comprising:

an insulative cover defining a plurality of grooves arranged in a row along a transversal direction;

a plurality of connectors accommodated in the grooves, respectively, each of the connectors having a terminal module and a metallic shell enclosing the terminal module;

a metallic cage enclosing the insulative cover; and a plurality of conductive members completely enclosed inside the metallic cage and disposed outside of the metallic shells of the connectors, each of the conductive member including a horizontal portion and a vertical portion, the horizontal portion having a first tab abutting against the metallic cage, and the vertical portion having a second tab pressing against the metallic shell of a corresponding connector.

2. The connector assembly as claimed in claim 1, wherein the first tab obliquely and upwardly extends from the horizontal portion.

3. The connector assembly as claimed in claim 2, wherein the second tab obliquely and upwardly extends from the vertical portion.

4. The connector assembly as claimed in claim 1, wherein the conductive member is of inverted L-shaped.

5. The connector assembly as claimed in claim 4, wherein the first tab is disposed above the horizontal portion, and the second tab is disposed under the horizontal portion.

6. The connector assembly as claimed in claim 1, wherein the first tab extends backwardly from the horizontal portion.

7. The connector assembly as claimed in claim 1, wherein the grooves are separated from each other by a number of spacers.

8. The connector assembly as claimed in claim 7, wherein the vertical portion of the conductive member is arranged alongside the corresponding connector and sandwiched between the metallic shell of the connector and a corresponding spacer.

9. The connector assembly as claimed in claim 8, wherein the horizontal portion of the conductive member is supported by the metallic shell of the connector.

10. The connector assembly as claimed in claim 1, wherein the insulative cover includes a top cover and a bottom cover together holding the connectors therebetween.

11. The connector assembly as claimed in claim 10, wherein the grooves are located in the bottom cover.

12. The connector assembly as claimed in claim 11, wherein there are a plurality of windows defined in an upper wall of the top cover, and the first tabs protrude outward via the windows, respectively.

13. The connector assembly as claimed in claim 10, wherein there are a number of positioning cavities located in an upper wall of the top cover, and there are a number of locking tabs formed on a top side of the metallic cage and extend into interior of the metallic cage to engage with the positioning cavities.

14. The connector assembly as claimed in claim 1, wherein there is a flange extending upwardly from a rear end of a top side of the metallic cage.

15. The connector assembly as claimed in claim 14, wherein there is at least one hook formed on the flange.

16. An electrical connector assembly comprising:

an insulative elongated cover defining a receiving cavity therein along a lengthwise direction;

a plurality of electrical connectors disposed in the receiving cavity with mating ports forwardly exposed to an exterior in a mating direction perpendicular to said mating direction, each of said connector being equipped with an outer metallic shell;

a metallic cage enclosing said insulative cover with front openings to expose the corresponding mating ports respectively; and a plurality of conductive members located in the receiving cavity beside the corresponding connectors, respectively; wherein each of said conductive members defines a first section mechanically and electrically connected to the shell of the corresponding connector, and a second section mechanically and electrically connected to the cage through a corresponding window formed in the cover.

17. The electrical connector assembly as claimed in claim 16, wherein said window is defined in a vertical direction perpendicular to said lengthwise direction and said mating direction.

18. The electrical connector assembly as claimed in claim 16, wherein the second section of each of said conductive members extends outwardly through the corresponding window to reach the cage.

19. The electrical connector assembly as claimed in claim 18, wherein the first section of each of said conductive members extends inwardly to reach the shell of the corresponding connector.

20. An electrical connector assembly comprising:

an insulative elongated cover defining a receiving cavity therein along a lengthwise direction;

a plurality of electrical connectors disposed in the receiving cavity with mating ports forwardly exposed to an exterior in a mating direction perpendicular to said mating direction, each of said connector being equipped with an outer metallic shell;

a metallic cage enclosing said insulative cover with front openings to expose the corresponding mating ports respectively; and a plurality of conductive members located in the receiving cavity beside the corresponding connectors, respectively; wherein each of said conductive members defines a vertical side with a spring finger contacting the shell of the corresponding connector and a horizontal side with another spring finger contacting the cage to form a grounding line therebetween.

* * * * *